United States Patent [19]

Bellati

[11] 4,456,426

[45] Jun. 26, 1984

[54] FASTENING DEVICE FOR A TURBINE HOUSING

[75] Inventor: Hans Bellati, Gordola, Switzerland

[73] Assignee: BBC Brown, Boveri & Company, Limited, Baden, Switzerland

[21] Appl. No.: 338,877

[22] Filed: Jan. 12, 1982

[30] Foreign Application Priority Data

Jan. 14, 1981 [CH] Switzerland ..... 212/81

[51] Int. Cl.[3] ..... B63B 25/14

[52] U.S. Cl. ..... 415/219 R; 415/134; 248/DIG. 1; 248/671

[58] Field of Search ..... 415/126, 219 R, 134; 248/DIG. 1, 671, 649, 657; 52/573, 167

[56] References Cited

U.S. PATENT DOCUMENTS

| | | | |
|---|---|---|---|
| 1,416,760 | 5/1922 | Steenstrup | 248/DIG. 1 |
| 1,491,423 | 4/1924 | Rice | 248/DIG. 1 |
| 1,678,968 | 7/1928 | Allen | 248/DIG. 1 |
| 1,814,626 | 7/1931 | Allen | 248/DIG. 1 |
| 2,777,665 | 1/1957 | Martinson | 415/134 |
| 3,556,672 | 1/1971 | Gentile | 415/134 |
| 4,050,660 | 9/1977 | Eggmann et al. | 415/219 R |
| 4,317,556 | 3/1982 | Dietrich | 415/219 R |

*Primary Examiner*—Stephen Marcus
*Assistant Examiner*—Brian J. Bowman
*Attorney, Agent, or Firm*—Burns, Doane, Swecker & Mathis

[57] ABSTRACT

To avoid torsional stress on a foundation crossbeam and undue movement of a bearing housing at the mounting point, it is proposed, in order to displace the fixed point of the stationary parts of a turbine, that the turbine housing be connected rigidly in an axial direction to the foundation crossbeam by a retaining device via a supporting rib and a sway brace. Further the turbine housing is mounted on the bearing housing via a mounting lug resting axially movably on a bearing face.

3 Claims, 3 Drawing Figures

FASTENING DEVICE FOR A TURBINE HOUSING

BACKGROUND AND SUMMARY OF THE INVENTION

The present invention relates to the fastening of a turbine housing to foundation crossbeams and to the bearing housing In the design of turbines which is conventional today, the axial forces are conveyed into the foundation crossbeam via transverse wedges, the bearing housing and the foundation plate or via foundation bolts and retaining blocks. In a known type of fastening of this kind, the fixed point, that is the point at which the axial stresses engage on the bearing housing, is located at the height of the shaft line. An unduly high torsional stress on the crossbeam can arise as a result. Also, because of the tilting movements associated therewith, the blade clearances and the play at the shaft seals can be changed so that blade-scraping and consequently uneven running of the shaft line occur. Moreover, there is also an increase in the axial forces which act on the fastening, especially in high-powered steam turbines, as a result of the action forces of the steam lines connected to the turbine housing and because of the increased friction arising during expansions of the housings as a result of their ever greater weights. However, since the space conditions, for example between the medium-pressure and low-pressure parts of the turbine, are restricted for constructional reasons, there is a limit to a corresponding larger dimensioning of the crossbeam of the foundation.

The object of the present invention is therefore to shift the fixed point for the stationary parts of a turbine, so that a high torsional stress on the foundation crossbeam and consequently undue movement of the bearing housing at the mounting point are avoided.

The abovementioned object and others are achieved, according to the invention, due to the fact that there is on the turbine housing at least one supporting rib which is connected rigidly in an axial direction to the foundation crossbeam via a sway brace and a retaining device. Further a mounting lug of the turbine housing is mounted axially movably on a supporting face of the bearing housing.

Because the turbine housing is fastened according to the present invention to the crossbeam via supporting ribs and sway braces, changes to the foundation crossbeam which are difficult and expensive in terms of construction can be avoided. In addition, the turbine housing is prevented from lifting on one side as a result of the occurence of tilting movements of the foundation crossbeam together with the bearing housing fastened thereto.

According to a further embodiment the sway braces are adjustable axially via eccentric bushes.

Precision adjustment, without play, is possible by means of this design.

It is also advantageous if set screws are located at the place of support on the foundation crossbeam.

The fixed point can thereby be adjusted in a simple way during assembly.

BRIEF DESCRIPTION OF THE DRAWINGS

An exemplary embodiment of the subject of the invention is illustrated, simplified, in the drawing in which like members bear like reference numerals and wherein.

DETAILED DESCRIPTION OF THE PREFERRED EMBODIMENT

Figure 1:
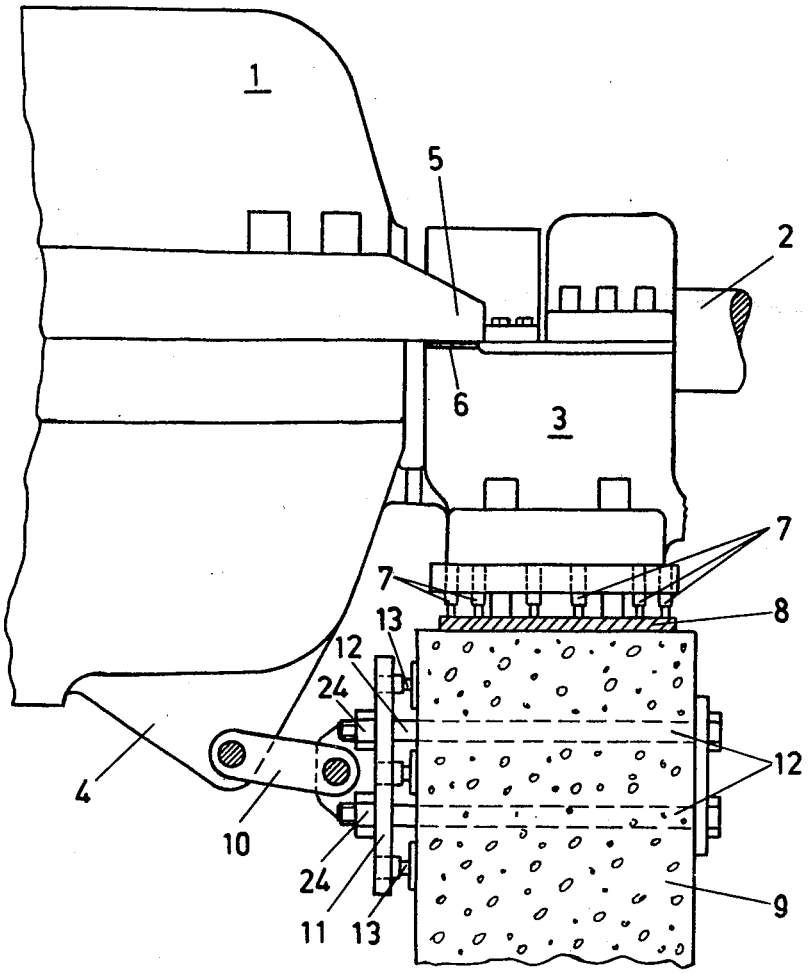
FIG. 1 is a side view of the fastening, according to the invention, of the turbine and bearing housings to the foundation crossbeam.

According to FIG. 1, a housing 1 of a turbine includes a shaft 2 which is mounted in a bearing housing 3. At least one supporting rib 4 is located on the lower part of the turbine housing 1, while on the upper part there is a mounting lug 5 which is mounted axially movable on a supporting face 6 of the bearing housing 3. The bearing housing 3 is mounted on a foundation crossbeam 9 via adjusting bolts 7 and a foundation plate 8, the adjusting bolts 7 serving for vertical adjustment. A sway brace 10 which is fastened to a retaining device 11 is located between the supporting rib 4 and the foundation crossbeam 9. The retaining device 11 is in turn fixed by retaining bolts 12 passing through the foundation crossbeam 9, to the crossbeam via adjusting screws 13 for rough axial adjustment.

Figure 2:
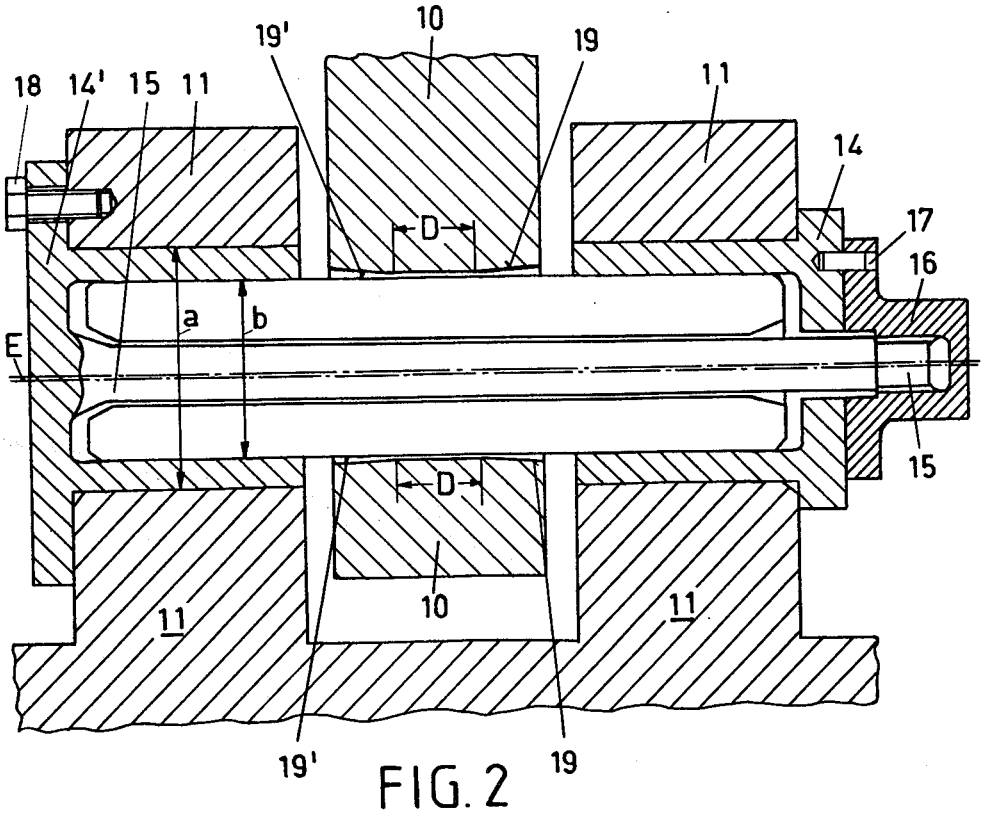
FIG. 2 is a longitudinal section through a sway brace.

By means of the sway brace 10 illustrated in FIG. 2, a precision adjustment of the distance between the turbine housing 1 and the foundation crossbeam 9 can be carried out according to the eccentric principle. For this purpose, the sway brace 10 has two eccentric bushes 14, 14' which are connected to one another via a spindle 15 and a nut 16 with a cylindrical pin 17. The eccentric bushes 14, 14' are mounted immovably in the retaining device 11. The diameters a, b of the eccentric bushes 14, 14' are radially offset by the eccentricity E. After precision adjustment has been carried out by rotating the eccentric bushes 14, 14' with the nut 16, their position can be secured by a fixing screw 18. The sway brace 10 itself has conical ends 19, 19' on its bearing faces on the spindle 15, as a result of which only a portion D rests on the spindle 15, and consequently greater mobility of the sway brace 10 is achieved.

Figure 3:
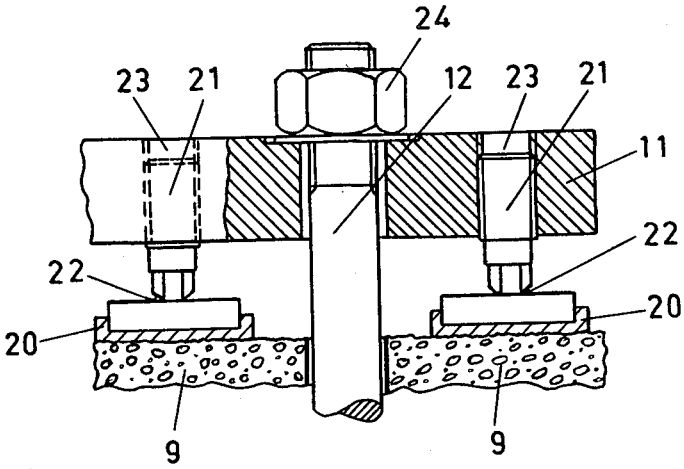
FIG. 3 is a detail of the rough adjustment on the foundation crossbeam, on an enlarged scale.

In the detailed view of the rough adjustment screws 13 of the retaining device 11 on the foundation crossbeam 9 according to FIG. 3, thrust plates 20 are arranged on the foundation crossbeam 9, and set screws 21 with spherical engagement faces 22 rest on the thrust plates 20. The set screws 21 are arranged rotatably in threaded bores 23 of the retaining device 11, so that rough adjustment of the fixed point can be carried out in this way. After this rough adjustment, the retaining device 11 is fixed in position by means of the retaining bolts 12 and nuts 24.

As a result of the fastening, according to the invention, of the turbine housing 1 to the foundation crossbeam 9, it is possible in a simple way to adjust the fixed point even during assembly of the installation.

The principles, preferred embodiment and mode of operation of the present invention have been described in the foregoing specification. However, the invention which is intended to be protected is not to be construed as limited to the particular embodiment disclosed. The embodiment is to be regarded as illustrative rather than restrictive. Variations and changes may be made by others without departing from the spirit of the present invention. Accordingly, it is expressly intended that all such variations and changes which fall within the spirit and scope of the present invention as defined in the claims be embraced thereby.

What is claimed is:

1. An arrangement for fastening a turbine housing to a foundation crossbeam and to a bearing housing, comprising at least one supporting rib on the turbine housing, said rib being connected in an axial direction of the turbine housing to the foundation crossbeam via a sway brace which is pivotably mounted to both the rib and a retaining device on the crossbeam, an axis of the pivotal mounting of at least one end of the sway brace being adjustable in the axial direction of the turbine housing, and a mounting lug of the turbine housing being axially slidably mounted on a supporting face of the bearing housing.

2. The arrangement according to claim 1, wherein the pivotal mounting of the sway brace is axially adjustable via eccentric bushes.

3. The arrangement according to claim 1, wherein the pivotal mounting of the sway brace is axially adjustable via set screws located on the retaining device for axial adjustment of the retaining device relative to the foundation crossbeam.

* * * * *